US010467905B2

(12) United States Patent
Lavoie et al.

(10) Patent No.: US 10,467,905 B2
(45) Date of Patent: Nov. 5, 2019

(54) USER CONFIGURABLE VEHICLE PARKING ALERT SYSTEM

(71) Applicant: Ford Global Technologies, LLC, Dearborn, MI (US)

(72) Inventors: Erick Michael Lavoie, Dearborn, MI (US); Miguel A. Bahena, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/744,482

(22) PCT Filed: Aug. 14, 2015

(86) PCT No.: PCT/US2015/045186
§ 371 (c)(1),
(2) Date: Jan. 12, 2018

(87) PCT Pub. No.: WO2017/030521
PCT Pub. Date: Feb. 23, 2017

(65) Prior Publication Data

US 2018/0204464 A1 Jul. 19, 2018

(51) Int. Cl.
*G08G 1/16* (2006.01)
*G08G 1/14* (2006.01)

(52) U.S. Cl.
CPC ..... *G08G 1/168* (2013.01); *G08G 1/14* (2013.01); *G08G 1/143* (2013.01)

(58) Field of Classification Search
CPC ..... G08G 1/168; G08G 1/04; G08G 1/143
See application file for complete search history.

(56) References Cited

U.S. PATENT DOCUMENTS

| | | | | |
|---|---|---|---|---|
| 6,275,231 | B1 | 8/2001 | Obradovich | |
| 8,306,734 | B2 | 11/2012 | Mathews | |
| 8,350,724 | B2 | 1/2013 | Szczerba et al. | |
| 8,610,597 | B2 | 12/2013 | Stefik et al. | |
| 8,698,895 | B2 | 4/2014 | Nerayoff et al. | |
| 8,854,231 | B2 | 10/2014 | Thomas et al. | |
| 8,963,740 | B2 | 2/2015 | Koukoumidis et al. | |
| 2005/0280555 | A1 | 12/2005 | Warner, IV | |
| 2011/0154259 | A1 | 6/2011 | Kennedy et al. | |
| 2012/0092191 | A1* | 4/2012 | Stefik | G06Q 10/02 340/932.2 |
| 2014/0122190 | A1 | 5/2014 | Wolfson et al. | |
| 2014/0266598 | A1* | 9/2014 | Narendra | G05B 1/03 340/5.81 |
| 2014/0292542 | A1* | 10/2014 | Bruning | B62D 15/027 340/932.2 |

OTHER PUBLICATIONS

Park Assist, Author Unknown, Volkswagen 2015, 2 pages.
Active Parking Assist, Author Unknown, Mercedes-Benz Intelligent Drive 2015, 3 pages.

* cited by examiner

*Primary Examiner* — Brian A Zimmerman
*Assistant Examiner* — Sara B Samson
(74) *Attorney, Agent, or Firm* — Gregory P. Brown; Brooks Kushman, P.C.

(57) ABSTRACT

A parking place alert system may include an interface, and a controller configured to generate an alert to be displayed via the interface and identifying a set of available park assist features selected in response to an indication that an available parking place is of a user identified type that defines a desired vehicle orientation and position relative to other parked vehicles.

13 Claims, 7 Drawing Sheets

USER CONFIGURABLE VEHICLE PARKING ALERT SYSTEM

CROSS-REFERENCE TO RELATED APPLICATION

This application is the U.S. national phase of PCT Application No. PCT/US15/045186 filed on Aug. 14, 2015, the disclosures of which is incorporated in its entirety by reference herein.

TECHNICAL FIELD

Disclosed herein are user configurable parking alert systems.

BACKGROUND

Parking guides and parking assist features are becoming increasingly prevalent in vehicles. Vehicle cameras and sensors are often used to display relevant vehicle views to aid the driver in parking the vehicle. Furthermore, some vehicles include self-park capabilities. As these systems increase in availability, alerts related to the features' availabilities may become burdensome.

SUMMARY

A parking place alert system may include an interface, and a controller configured to generate an alert to be displayed via the interface and identifying a set of available park assist features selected in response to an indication that an available parking place is of a user identified type that defines a desired vehicle orientation and position relative to other parked vehicles.

A park assist system may include an interface, and a controller configured to associate a selected parking place type defining a desired vehicle orientation and position relative to other parked vehicles with a user profile, and generate an alert via the interface in response to the user profile being active and an indication that an available parking place is of the selected parking place type A method may include presenting via an interface a list of a plurality of parking place types each defining a desired vehicle orientation and position relative to other parked vehicles, associating, in response to a selection of one of the parking place types, a user identifier and the selected parking place type with a user profile, and generating an alert to be displayed via the interface in response to the user profile being active and an indication that an available parking place is of the selected parking place type.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Parking features including park assist and visual guides are often available to drivers to aid the driver in parking a vehicle. When a vehicle recognizes an available parking place, typically via ultrasonic sensor data, the vehicle, via an interface or button, may alert the user that a parking feature is available for use. However, often times, parking places are easily accessible to the vehicle, and the driver may find it unnecessary to use such feature. By alerting the driver each time this feature is available may diminish the use of the feature during more practical situations because the user may become accustomed to ignoring the alert. Furthermore, unnecessary alerts may distract the driver. Disclosed herein is a user configurable vehicle parking alert system that allows a user to set his or alert preferences via a user profile with respect to various types of parking places. For example, a user may wish to use park assist for parallel parking, but the user may not wish to use park assist for perpendicular parking. These user preferences may be saved and applied to eliminate unnecessary distractions while driving and increase use of the vehicle parking features. A user-friendly interface may be displayed to allow the user to easily select/deselect certain types of parking places.

Figure 1A:
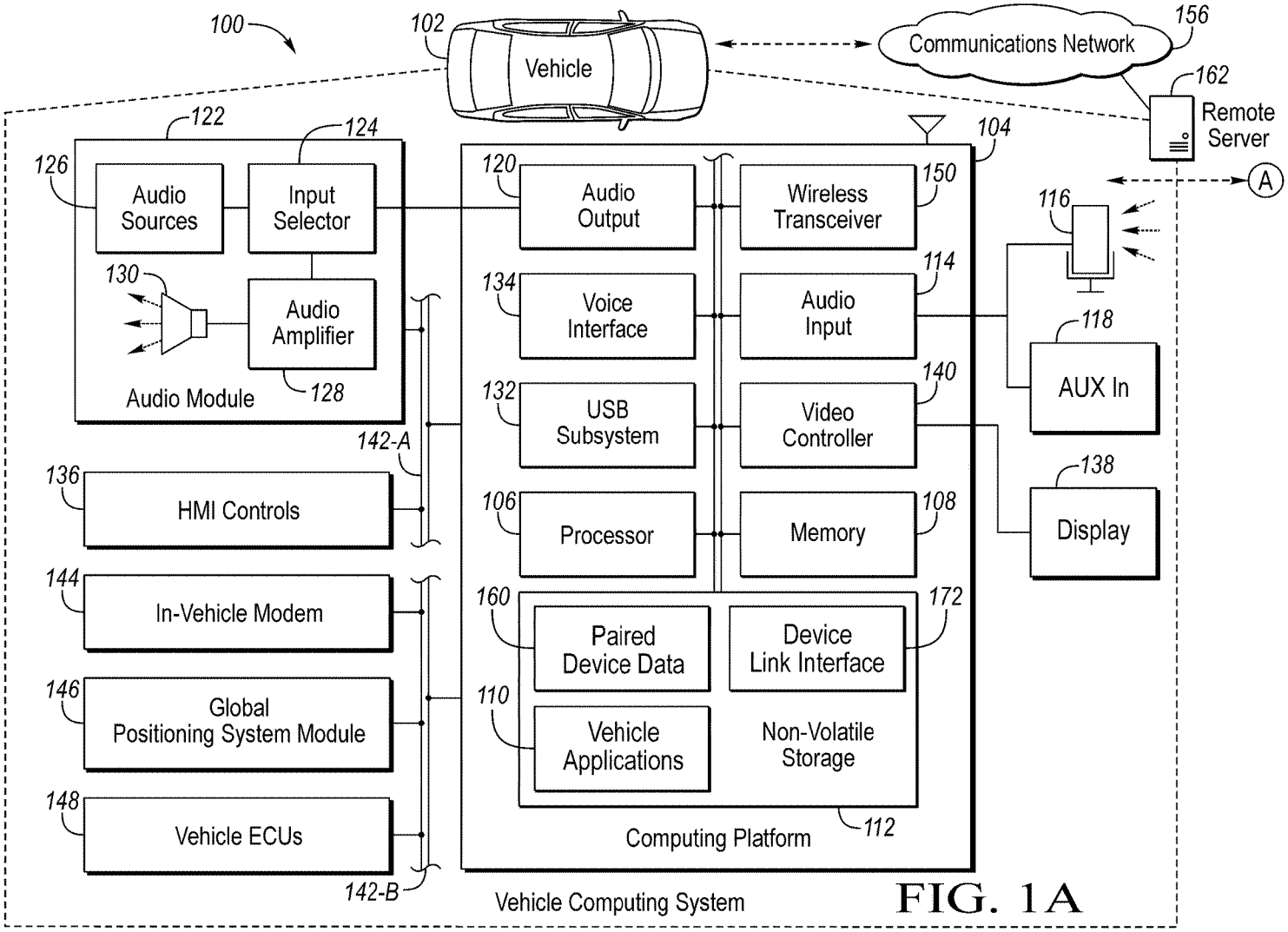
FIGS. 1A and 1B illustrate an example diagram of a system that may be used to provide telematics services to a vehicle.
Figure 1B:
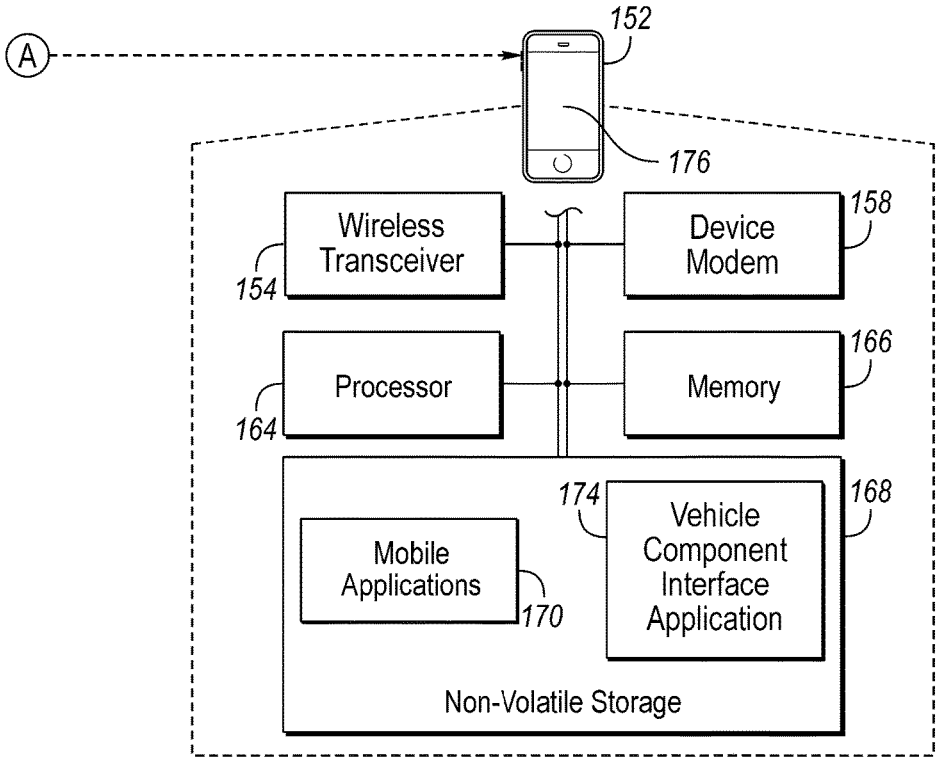

FIGS. 1A and 1B illustrate an example diagram of a system 100 that may be used to provide telematics services to a vehicle 102. The vehicle 102 may be one of various types of passenger vehicles, such as a crossover utility vehicle (CUV), a sport utility vehicle (SUV), a truck, a recreational vehicle (RV), a boat, a plane or other mobile machine for transporting people or goods. Telematics services may include, as some non-limiting possibilities, navigation, turn-by-turn directions, vehicle health reports, local business search, accident reporting, and hands-free calling. In an example, the system 100 may include the SYNC system manufactured by The Ford Motor Company of Dearborn, Mich. It should be noted that the illustrated system 100 is merely an example, and more, fewer, and/or differently located elements may be used.

The computing platform 104 may include one or more processors 106 and controllers configured to perform instructions, commands and other routines in support of the processes described herein. For instance, the computing platform 104 may be configured to execute instructions of vehicle applications 110 to provide features such as navigation, accident reporting, satellite radio decoding, hands-free calling and parking assistance. Such instructions and other data may be maintained in a non-volatile manner using a variety of types of computer-readable storage medium 112. The computer-readable medium 112 (also referred to as a processor-readable medium or storage) includes any nontransitory medium (e.g., a tangible medium) that participates in providing instructions or other data that may be read by the processor 106 of the computing platform 104. Computer-executable instructions may be compiled or interpreted from computer programs created using a variety of programming languages and/or technologies, including, without limitation, and either alone or in combination, Java, C, C++, C#, Objective C, Fortran, Pascal, Java Script, Python, Perl, and PL/SQL.

The computing platform 104 may be provided with various features allowing the vehicle occupants to interface with the computing platform 104. For example, the computing platform 104 may include an audio input 114 configured to receive spoken commands from vehicle occupants through a connected microphone 116, and auxiliary audio input 118 configured to receive audio signals from connected devices. The auxiliary audio input 118 may be a physical connection, such as an electrical wire or a fiber optic cable, or a wireless input, such as a BLUETOOTH audio connection. In some examples, the audio input 114 may be configured to provide audio processing capabilities, such as pre-amplification of low-level signals, and conversion of analog inputs into digital data for processing by the processor 106.

The computing platform 104 may also provide one or more audio outputs 120 to an input of an audio module 122 having audio playback functionality. In other examples, the computing platform 104 may provide the audio output to an occupant through use of one or more dedicated speakers (not illustrated). The audio module 122 may include an input selector 124 configured to provide audio content from a selected audio source 126 to an audio amplifier 128 for playback through vehicle speakers 130 or headphones (not illustrated). The audio sources 126 may include, as some examples, decoded amplitude modulated (AM) or frequency modulated (FM) radio signals, and audio signals from compact disc (CD) or digital versatile disk (DVD) audio playback. The audio sources 126 may also include audio received from the computing platform 104, such as audio content generated by the computing platform 104, audio content decoded from flash memory drives connected to a universal serial bus (USB) subsystem 132 of the computing platform 104, and audio content passed through the computing platform 104 from the auxiliary audio input 118.

The computing platform 104 may utilize a voice interface 134 to provide a hands-free interface to the computing platform 104. The voice interface 134 may support speech recognition from audio received via the microphone 116 according to grammar associated with available commands, and voice prompt generation for output via the audio module 122. In some cases, the system may be configured to temporarily mute or otherwise override the audio source specified by the input selector 124 when an audio prompt is ready for presentation by the computing platform 104 and another audio source 126 is selected for playback.

The computing platform 104 may also receive input from human-machine interface (HMI) controls 136 configured to provide for occupant interaction with the vehicle 102. For instance, the computing platform 104 may interface with one or more buttons or other HMI controls configured to invoke functions on the computing platform 104 (e.g., steering wheel audio buttons, a push-to-talk button, instrument panel controls, etc.). The computing platform 104 may also drive or otherwise communicate with one or more displays 138 configured to provide visual output to vehicle occupants by way of a video controller 140. In some cases, the display 138 may be a touch screen further configured to receive user touch input via the video controller 140, while in other cases the display 138 may be a display only, without touch input capabilities.

Figure 2:
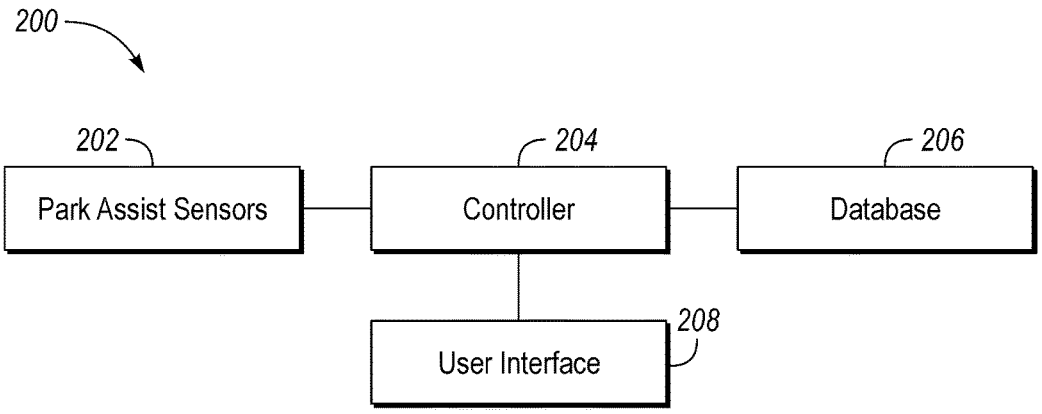
FIG. 2 illustrates an example block diagram of a parking alert system.

The computing platform 104 may be further configured to communicate with other components of the vehicle 102 via one or more in-vehicle networks 142. The in-vehicle networks 142 may include one or more of a vehicle controller area network (CAN), an Ethernet network, and a media oriented system transfer (MOST), as some examples. The in-vehicle networks 142 may allow the computing platform 104 to communicate with other vehicle 102 systems, such as a vehicle modem 144 (which may not be present in some configurations), a global positioning system (GPS) module 146 configured to provide current vehicle 102 location and heading information, and various vehicle ECUs 148 configured to cooperate with the computing platform 104. As some non-limiting possibilities, the vehicle ECUs 148 may include a powertrain control module configured to provide control of engine operating components (e.g., idle control components, fuel delivery components, emissions control components, etc.) and monitoring of engine operating components (e.g., status of engine diagnostic codes); a body control module configured to manage various power control functions such as exterior lighting, interior lighting, keyless entry, remote start, and point of access status verification (e.g., closure status of the hood, doors and/or trunk of the vehicle 102); a radio transceiver module configured to communicate with key fobs or other local vehicle 102 devices; and a climate control management module configured to provide control and monitoring of heating and cooling system components (e.g., compressor clutch and blower fan control, temperature sensor information, etc.), and other sensors such as sensors 202, as shown in FIG. 2, etc.

As shown, the audio module 122 and the HMI controls 136 may communicate with the computing platform 104 over a first in-vehicle network 142-A, and the vehicle modem 144, GPS module 146, and vehicle ECUs 148 may communicate with the computing platform 104 over a second in-vehicle network 142-B. In other examples, the computing platform 104 may be connected to more or fewer in-vehicle networks 142. Additionally or alternately, one or more HMI controls 136 or other components may be connected to the computing platform 104 via different in-vehicle networks 142 than shown, or directly without connection to an in-vehicle network 142.

The computing platform 104 may also be configured to communicate with mobile devices 152 of the vehicle occupants. The mobile devices 152 may be any of various types of portable computing device, such as cellular phones, tablet computers, smart watches, laptop computers, portable music players, or other devices capable of communication with the computing platform 104. In many examples, the computing platform 104 may include a wireless transceiver 150 (e.g., a BLUETOOTH module, a ZIGBEE transceiver, a Wi-Fi transceiver, an IrDA transceiver, an RFID transceiver, etc.) configured to communicate with a compatible wireless transceiver 154 of the mobile device 152. Additionally or alternately, the computing platform 104 may communicate with the mobile device 152 over a wired connection, such as via a USB connection between the mobile device 152 and the USB subsystem 132.

The communications network 156 may provide communications services, such as packet-switched network services (e.g., Internet access, VoIP communication services), to devices connected to the communications network 156. An example of a communications network 156 may include a cellular telephone network. Mobile devices 152 may provide network connectivity to the communications network 156 via a device modem 158 of the mobile device 152. To facilitate the communications over the communications network 156, mobile devices 152 may be associated with unique device identifiers (e.g., mobile device numbers (MDNs), Internet protocol (IP) addresses, etc.) to identify the communications of the mobile devices 152 over the communications network 156. In some cases, occupants of the vehicle 102 or devices having permission to connect to the computing platform 104 may be identified by the computing platform 104 according to paired device data 160 maintained in the storage medium 112. The paired device data 160 may indicate, for example, the unique device identifiers of mobile devices 152 previously paired with the computing platform 104 of the vehicle 102, such that the computing platform 104 may automatically reconnected to the mobile devices 152 referenced in the paired device data 160 without user intervention.

When a mobile device 152 that supports network connectivity is paired with the computing platform 104, the mobile device 152 may allow the computing platform 104 to use the network connectivity of the device modem 158 to communicate over the communications network 156 with the remote telematics services 162. In one example, the computing platform 104 may utilize a data-over-voice plan or data plan of the mobile device 152 to communicate information between the computing platform 104 and the communications network 156. Additionally or alternately, the computing platform 104 may utilize the vehicle modem 144 to communicate information between the computing platform 104 and the communications network 156, without use of the communications facilities of the mobile device 152.

Similar to the computing platform 104, the mobile device 152 may include one or more processors 164 configured to execute instructions of mobile applications 170 loaded to a memory 166 of the mobile device 152 from storage medium 168 of the mobile device 152. In some examples, the mobile applications 170 may be configured to communicate with the computing platform 104 via the wireless transceiver 154 and with the remote telematics services 162 or other network services via the device modem 158. The computing platform 104 may also include a device link interface 172 to facilitate the integration of functionality of the mobile applications 170 into the grammar of commands available via the voice interface 134 as well as into display 138 of the computing platform 104. The device link interfaced 172 may also provide the mobile applications 170 with access to vehicle information available to the computing platform 104 via the in-vehicle networks 142. Some examples of device link interfaces 172 include the SYNC APPLINK component of the SYNC system provided by The Ford Motor Company of Dearborn, Mich., the CarPlay protocol provided by Apple Inc. of Cupertino, Calif., or the Android Auto protocol provided by Google, Inc. of Mountain View, Calif. The vehicle component interface application 174 may be once such application installed to the mobile device 152.

The vehicle component interface application 174 of the mobile device 152 may be configured to facilitate access to one or more vehicle 102 features made available for device configuration by the vehicle 102. In some cases, the available vehicle 102 features may be accessible by a single vehicle component interface application 174, in which case such the vehicle component interface application 174 may be configured to be customizable or to maintain configurations supportive of the specific vehicle 102 brand/model and option packages. In an example, the vehicle component interface application 174 may be configured to receive, from the vehicle 102, a definition of the features that are available to be controlled, display a user interface descriptive of the available features, and provide user input from the user interface to the vehicle 102 to allow the user to control the indicated features. As exampled in detail below, an appropriate mobile device 152 to display the vehicle component interface application 174 may be identified (e.g. mobile display 176), and a definition of the user interface to display may be provided to the identified vehicle component interface application 174 for display to the user.

Systems such as the system 100 may require mobile device 152 pairing with the computing platform 104 and/or other setup operations. However, as explained in detail below, a system may be configured to allow vehicle occupants to seamlessly interact with user interface elements in their vehicle or with any other framework-enabled vehicle, without requiring the mobile device 152 or wearable device to have been paired with or be in communication with the computing platform 104.

FIG. 2 illustrates an example block diagram of a vehicle parking alert system 200 (also referred to as parking system 200). The vehicle parking alert system 200 may be configured as part of computing platform 104. The parking system 200 may also be a standalone system, or configured as part of mobile device 152 and/or remote server 162. The parking system 200 may include at least one sensor 202 configured to detect distances of objects external to the vehicle 102. The sensors 202 may be sensors typically used by park assist features that are configured to provide data which is in turn used to aid a user or driver in parking a vehicle. The sensors 202 may be ultrasonic sensors, infrared sensors, laser sensors, optical sensors, etc. The sensors 202 may additionally provide data that may be interpreted to indicate an available parking place by the controller 204.

The sensors 202 may also include on or more cameras capable of imaging areas around the vehicle 102. As the camera images certain areas while the vehicle 102 is driving, the computing platform 104 may recognize certain available parking places by analyzing various image frames. The camera images may also provide dimensions of available parking places, among other attributes.

The parking system 200 may include a controller 204 having a processor and a memory for carrying out certain processes and instructions described herein. Although shown as a separate component, the controller 204 may be within or part of the computing platform 104. Similarly, a database 206 may be maintained within the computer-readable medium 112, which may also participate in providing instructions and other data that may be read by the processor 106 of the computing platform 104. The database 206 may maintain and catalog certain user preferences as they relate to parking alerts in a user profile. While the database 206 is shown and described herein by way of example as being maintained within the computer-readable medium 112, the database 206 may also be maintained within the mobile device 152. A driver may updated and change his or her preferences at the mobile devices 152, including when the mobile device 152 is remote from the vehicle 102, and the mobile devices 152 may provide updated preferences to the computing platform 104 upon connecting with the vehicle.

The user interface 208 may be any interface configured to display certain information to the user. In one example, the interface 208 may be displayed via the vehicle display 138. In another example, the interface 208 may be displayed via the mobile display 176. The interface 208, as described in more detail below with respect to FIGS. 3A-3G, may provide various selectable options indicating various user preferences, as well as certain screens illustrating various parking situations.

Figure 3A:
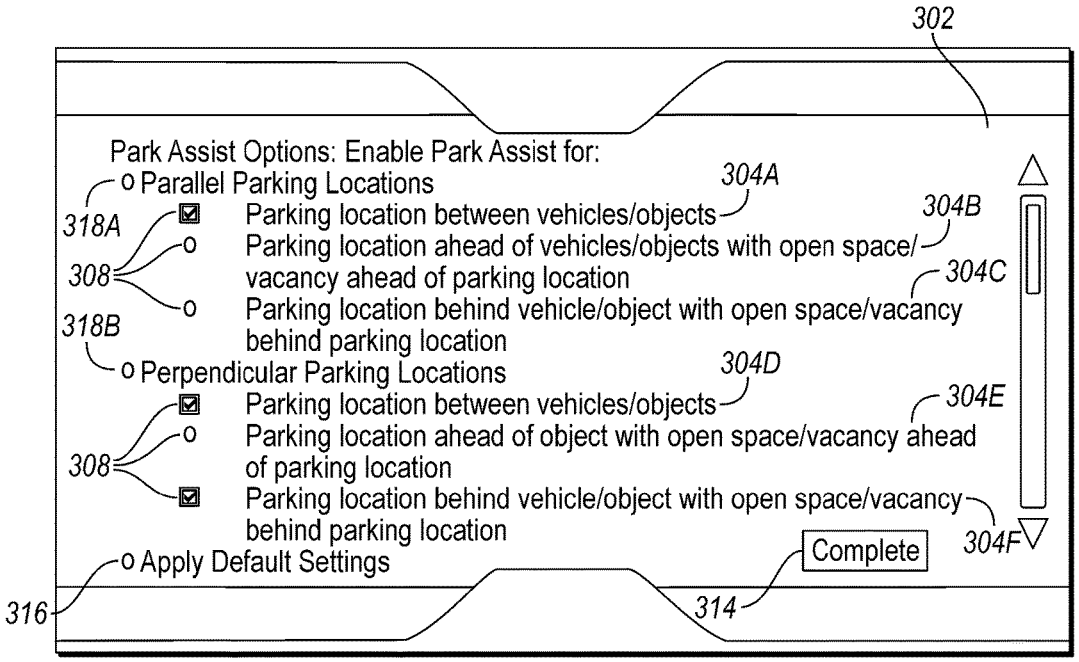
FIGS. 3A-3G illustrate example interface screens for the parking alert system.

FIGS. 3A-3G illustrates example screens displayed via the interface 208. FIG. 3A illustrates an example parking alert option screen 302. The parking alert option screen 302 may be displayed via the interface 208 in response to selecting a parking alert option (not shown). This screen may allow a user to customize his or her settings with respect to the type of alerts he or she receives when driving the vehicle 102. As explained above, some users may wish to take advantage of certain park assist features available during driving. These park assist features may include certain guides that aid the user in parallel parking, perpendicular parking, angled parking, etc. The guided aids may provide visual guides via the interface 208, which may include camera views, including directional lines to help guide the user to maneuver the vehicle 102 into a specific parking place. Additionally or alternatively, an active park assist feature, may also control the vehicle 102 (e.g., control the drive train and wheel direction) in order to park the vehicle, without user interaction at the steering wheel, or otherwise.

In some situations, depending on user preferences, the guide and/or park assist is a welcomed feature. For example, in a crowded street, with vehicles parallel parking along the side of the road, a user may welcome help with parking of the vehicle, either via visual aids at the interface 208, or with active park assist. In other situations, where the vehicle 102 recognizes a parking place based on sensor data, and the parking place is relatively easy to access (e.g., the vehicle 102 may be driven forward into the parking place), a user may find parking aids or guides unnecessary. In this example, alerting the user as to the availability of park assist features may be distractive and unnecessary given the ease that the driver may park the vehicle 102. Nonetheless, some drivers may wish to be alerted about certain types of parking places, while others may not.

FIG. 3A illustrates the example screen 302 for selecting user references related to park assist features. Screen 302 may provide a list of selectable parking place types 304A-304F (collectively parking place type or parking place types 304). Upon selecting a respective parking place type 304, a selection indicator 308 may be displayed next to the parking place type 304 indicating whether a respective type 304 is selected. In the example shown, types 304A, 304D and 304F have been selected. Further, each of the parking place types 304 may function as a hyperlink to another screen. Upon selecting one of the parking place types 304 (e.g., selecting the text indicating the type), a screen 310 showing a top-view arrangement relating to the type 304 may be displayed.

Figure 3B:
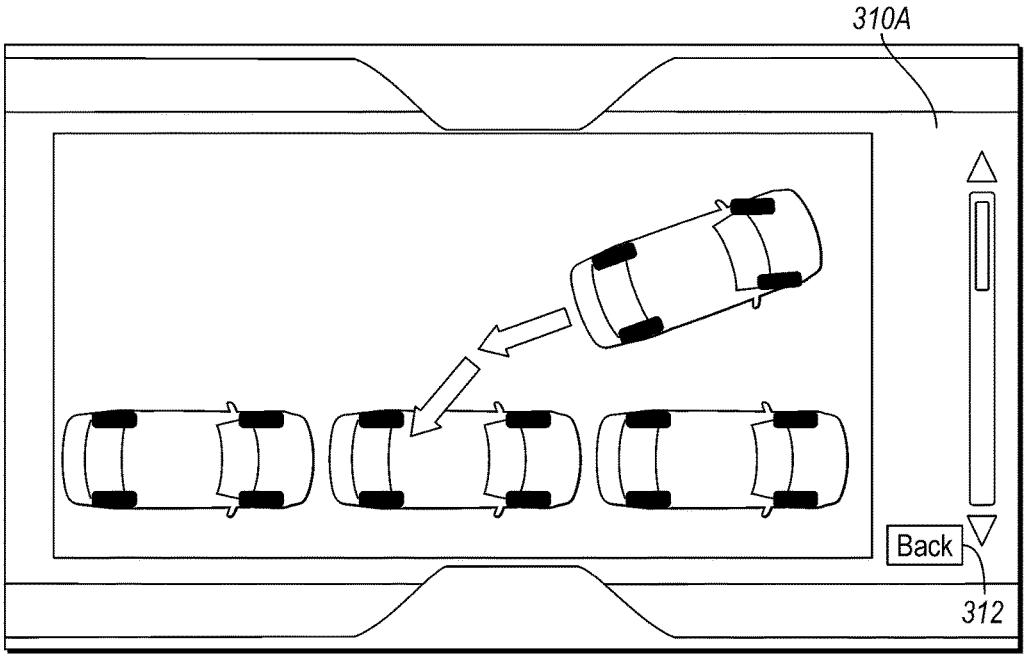
Figure 3C:
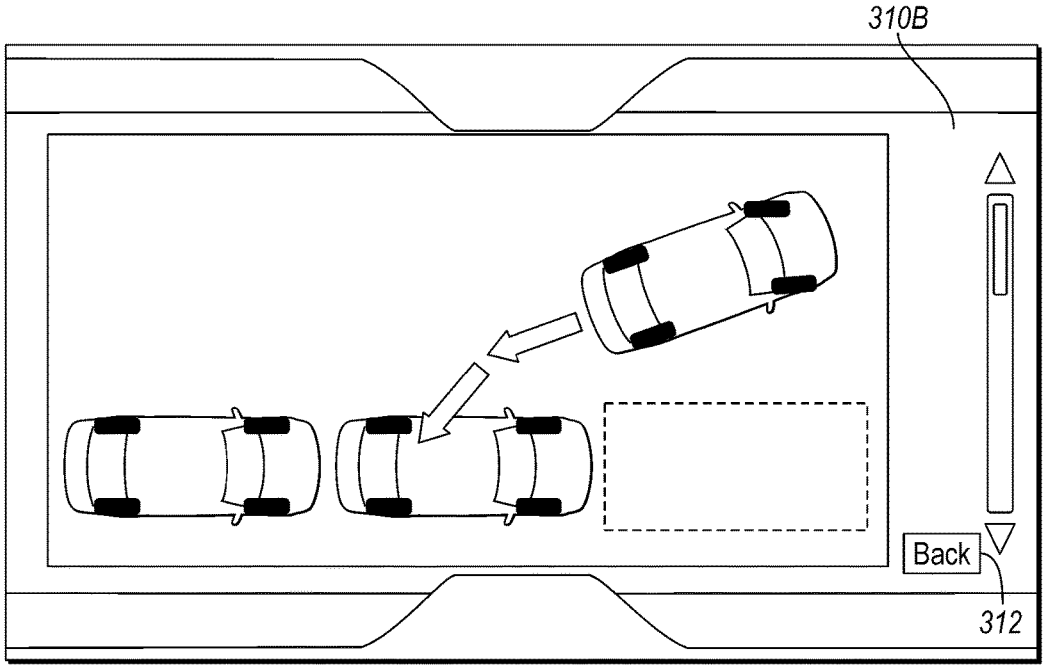

The parking place types may correspond to a desired vehicle orientation or placement with respect other parked vehicles. By way of example, a first parking place type 304A may be a parallel parking location between two vehicles. Selecting the hyperlink for the first type 304A may display a pictorial screen 310A similar to that as shown in FIG. 3B. FIG. 3B illustrates a parallel parking situation where a vehicle is attempting to parallel park between two adjacent vehicles. This pictorial representation may help the driver understand each parking situation and determine whether it is a situation in which he or she would likely take advantage of park assist features.

A second parking place type 304B may be a parallel parking place ahead of another parked vehicle. However, unlike the situation as depicted in FIG. 3B, an open space or vacant parking place may be in front of the available parking place. This situation is illustrated by way of example in pictorial screen 310B of FIG. 3C.

Figure 3D:
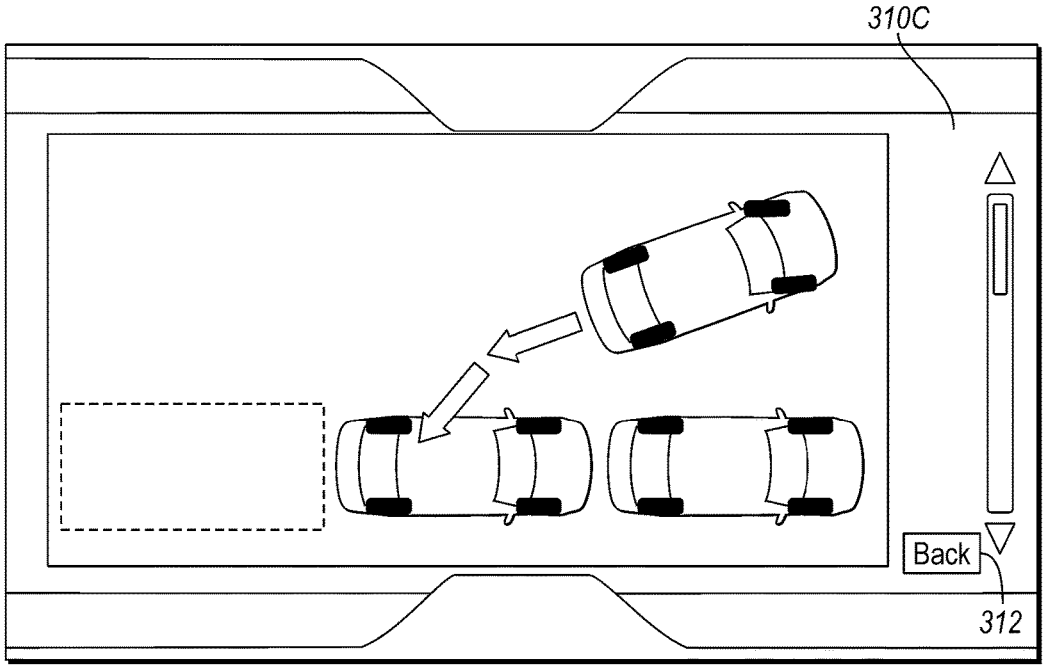

FIG. 3D illustrates pictorial screen 310C showing a parallel parking situation where a parking place is available behind a parked vehicle with an opening or vacancy behind the parking place.

Figure 3E:
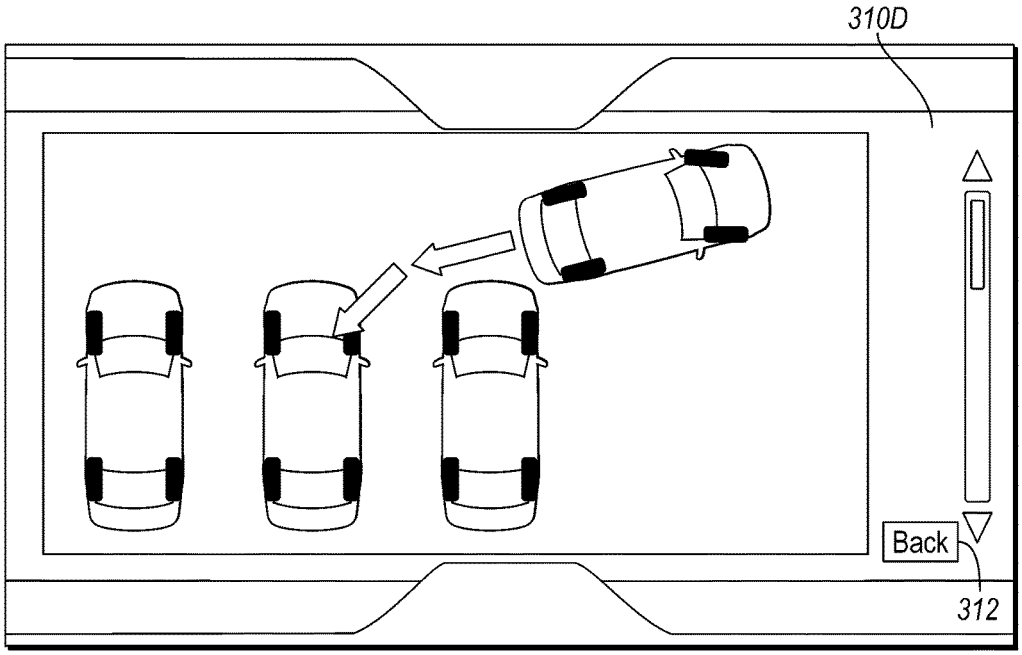
Figure 3F:
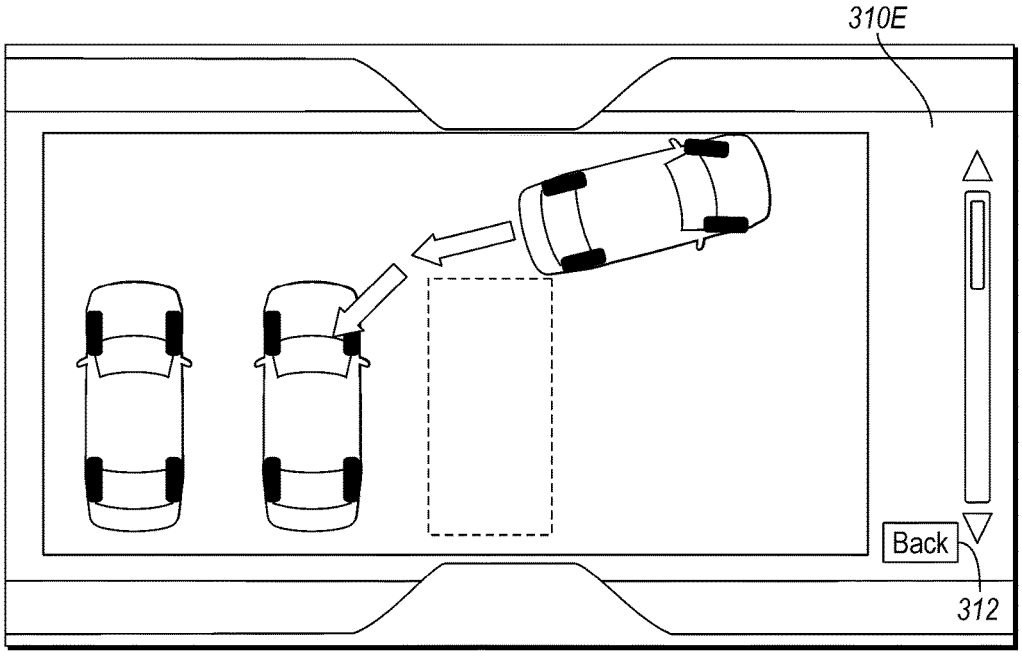
Figure 3G:
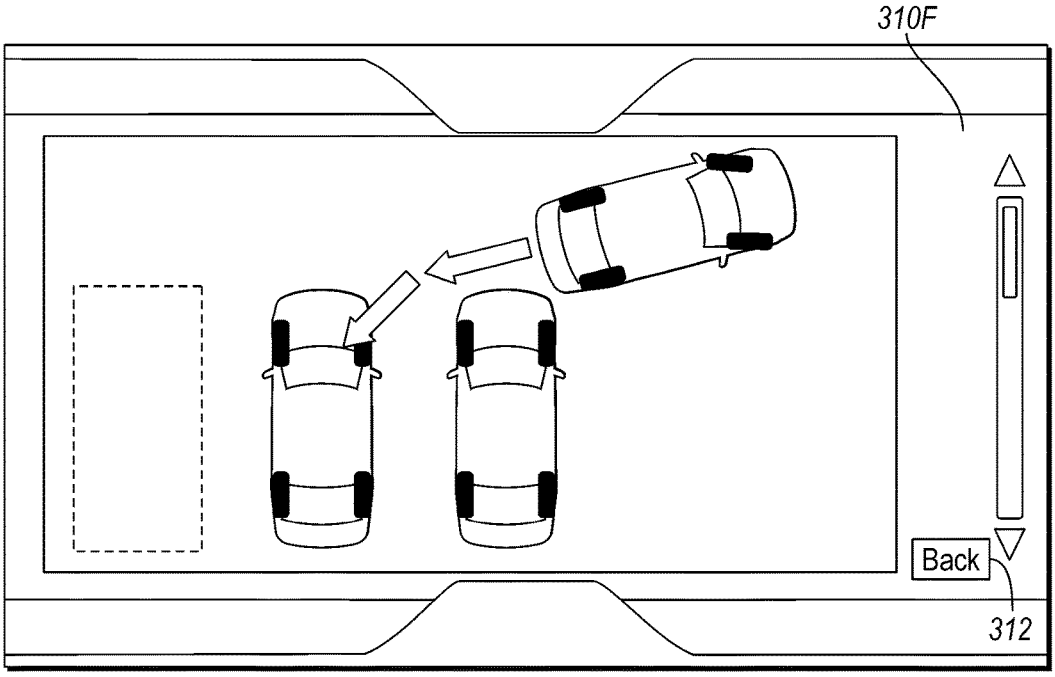

FIG. 3E illustrates a pictorial screen 310D showing a perpendicular parking situation where a parking place is available between two perpendicularly parked vehicles relating to parking place type 304D. FIG. 3F illustrates a pictorial screen 310D showing a similar situation as FIG. 3E but with a vacancy ahead of the parking place, corresponding to parking place type 304E. FIG. 3G illustrates a pictorial screen 310F showing a vacant parking place behind the parking place, corresponding to parking place type 304F.

Although not shown, other parking situations may be included in the parking place types 304 and associated pictorial representations may be provided for each. In one example, various types of angled parking (e.g., 30 degrees, 45 degrees, or 60 degrees,) may be included in the list of parking place types 304.

While individual parking place types 304 may be selected and deselected, the parking place types 304 may also be selected as a group. For example, a group 318 may be selected for all parking place types 304 falling under that group. As indicated in FIG. 3A, a group 310 may include a parallel parking group 318A, as well as a perpendicular parking group 318B.

A default selection 316 may be selected to apply default settings. The default selection 316 may apply certain parking types 304 to the user profile without other input from the user. In one example, the default selection 316 may include the selected types 304 shown in FIG. 3A (e.g., types 304A, 304D and 304F).

Users may make their selections based on their personal preferences. For example, one user may be comfortable parking a vehicle in one situation but not another. Allowing the user to select which of these situations he or she would most likely use a park assist feature for, provides a better customer experience and increases the use of the feature.

Further, by illustrating a list of selectable parking place types 304, and by showing pictorial examples of each type, a user may make an informed decision about the types of alerts he or she wishes to receive with respect to available parking places. The alerts may include several types of alerts, but generally may relate to the availability of parking aids for a certain type of parking place. That is, upon selecting the types 304 of parking places, the user will be alerted that park assist is available only for those selected parking place types 304. This may eliminate unnecessary distractions to the user during driving in that the park assist features are made available in situations where the user is highly likely to use the feature.

Each pictorial screen 310 may include a back button 312 configured to return the interface 208 to the option screen 302 upon selection. Upon completing selections of the parking place types 304, the user may select a complete button 314 to close the option screen 302 and save the selections in the database 206. The user selections may be saved and catalogued with the specific user, which may be identified via a unique user identifier such as a user ID, key fob, biometric data, etc.

Figure 4:
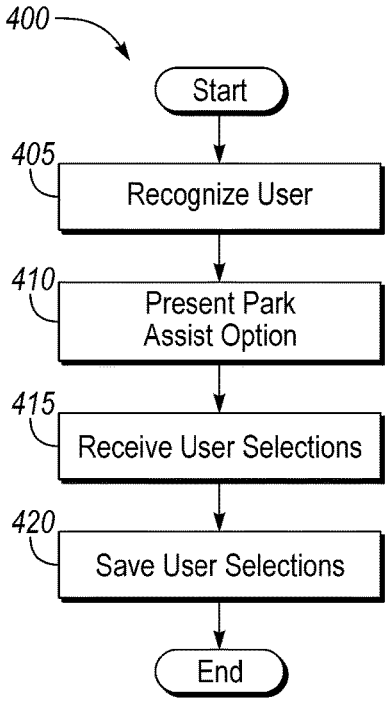
FIG. 4 illustrates an example process for establishing user preferences for the parking alert system.

FIG. 4 illustrates an example process 400 for establishing user preferences for the parking alert system. The process 400 begins at block 405 where the controller 204, or computing platform 104, recognizes the user. The user may be recognized by the mechanism used to gain access (e.g., unlock) to the vehicle 102. For example, if the user uses a key fob, the key fob's uniuqe key may identify the specific user. If a fingerprint scan is used to gain access, than the fingerprint may recognize the user.

At block 410, the controller 204 may instruct the interface 208 to display the option screen 302. This may be done in response to a selection of an option button (not shown) at the interface 208. Additionally or alternatively, the option screen 302 may be presented in response to recognizing a user that has not previously set up his or her parking alert preferences. In one example, if it is the first time a certain user is driving the vehicle 102, then the option screen 302 may automatically be presented.

At block 415, the controller 204 may receive the user's selected parking place types selections and save the selections in the database 206 at block 420. The selections may then be recalled each time the recognized driver is driving the vehicle 102. In one example, once a driver establishes his or her preferences, the preferences may then be stored and recalled by other vehicles that the user may drive. That is, once the preferences are saved and associated with the user, the preferences may be globally applied without being limited to a single vehicle. The preferences may be maintained until the user updates or deletes his or her the preferences. The process 400 may then end.

Figure 5:
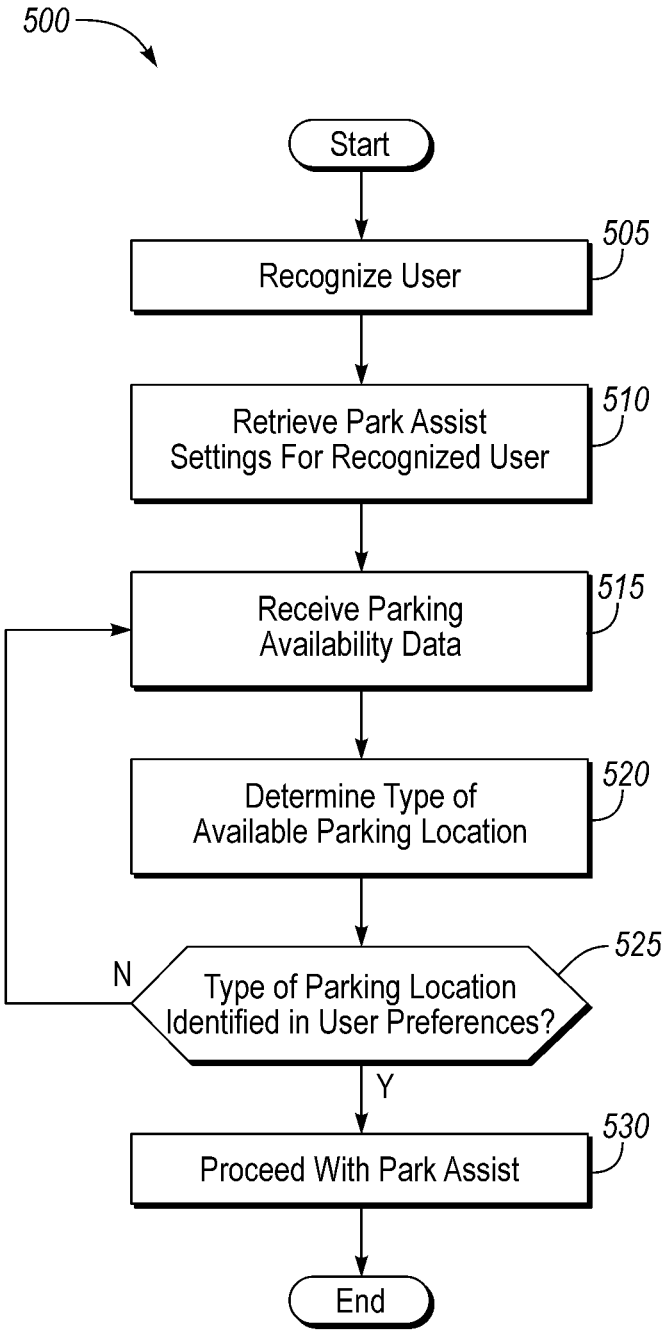
FIG. 5 illustrates another example process for implementing the parking alert system based on user preferences.

FIG. 5 illustrates an example process 500 for implementing the parking alert system based on the stored user preferences. The process 500 begins at block 505 where the controller 204 recognizes the user. As explained, this may be done via a unique identifier from a key fob, biometric reading, unique code inputted by the user, etc.

At block 510, the controller 204 may retrieve the alert selections for the selected parking place types 304 from the database 206 for the recognized user.

At block 515, the controller 204 may retrieve parking availability data as made available by the sensor data. The parking availability data may be derived from the sensor data and analyzed by the controller 204 to determine if and where available parking places are located.

At block 520, the controller 204, upon retrieving the parking availability data, may determine the type of available parking place, if any.

At block 525, the controller 204 may determine whether the available parking place is a type of parking place identified within the retrieved settings indicating the selected parking place types 304. That is, the controller 204 determines if the available parking place is a type of parking place where the user is likely to use the park assist features. If so, the process 500 proceeds to block 530. If not, the process proceeds to block 515.

At block 530, the controller 204 instructs the interface 208 to proceed with the park assist alert. The interface 208 may display a park assist option in response to the controller 204 recognizing a type of parking place that aligns with the user selected parking place types. Additionally or alternatively, the alert may take the form of illuminating a park assist button within the vehicle, but separate from the interface 208. The process may then end.

While processes 400 and 500 are described as being implemented via the controller 204, other controllers and processors, such as computing platform 104, remote server 162, etc., may also be used to carry out the instructions and processes described above.

Accordingly, a user customizable park assist alert system may be provided to allow users to select which parking situations may trigger an alert with respect to certain park assist features. That is, the user may select which type of parking places the park assist features may be made available for. Allowing the users to be alerted to park assist features when certain types of parking places, but not others, are available, may eliminate unnecessary distractions during driving. Moreover, the user-friendly interface may create and allow for descriptive pictorial screens of the various parking situations, which in turn increases understanding and usability of the park assist features.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A parking place alert system comprising: an interface; and a controller configured to present a list of parking place types that defines a desired vehicle orientation and position relative to other parked vehicles including a hyperlink for each of the parking place types configured to, when selected, display a pictorial representation of the respective parking place type, and generate an alert to be displayed via the interface and identifying a set of available park assist features selected in response to an indication that an available parking place is of a selected parking place type.

2. The system of claim 1, wherein the alert includes a selectable option for at least one of the set of park assist features.

3. The system of claim 1, wherein the selected parking place type is maintained within a user profile associated with a user.

4. The system of claim 1 further comprising an ultrasonic sensor or camera in communication with the controller and configured to detect the available parking place.

5. A park assist system comprising:

an interface, and a controller configured to present a list of parking place types including a hyperlink for each of the parking place types configured to, when selected, display a pictorial representation of the respective parking place type, and associate a selected parking place type defining a desired vehicle orientation and position relative to other parked vehicles with a user profile, and generate an alert via the interface in response to the user profile being active and an indication that an available parking place is of the selected parking place type.

6. The system of claim 5, wherein each of the parking place types is associated with a selection indicator configured to indicate whether the respective selectable parking place type is selected.

7. A method comprising:

presenting via an interface a list of groups each including of a plurality of parking place types each defining a desired vehicle orientation and position relative to other parked vehicles, the groups including a parallel parking group and a perpendicular parking group;

in response to receiving a selection of one of the parking place types contained within one of the groups, selecting other of the parking place types contained within the one of the groups associating, in response to the selection of one of the parking place types, a user identifier and the selected parking place type with a user profile; and generating an alert to be displayed via the interface in response to the user profile being active and an indication that an available parking place is of the selected parking place type.

8. The method of claim 7, wherein each of the parking place types is associated with a selection indicator configured to indicate whether the associated parking place type is selected.

9. The method of claim 7, wherein each of the groups includes at least one default selectable option.

10. The method of claim 7, wherein each of the parking place types includes a hyperlink configured to, when selected, display a pictorial representation of the parking place type.

11. The method of claim 10, wherein the pictorial representation includes at least one parking situation associated with the parking place type.

12. The method of claim 11, wherein the at least one parking situation includes at least one of a parallel parking situation and a perpendicular parking situation.

13. The method of claim 7, further comprising receiving the user identifier from a key fob.

* * * * *